United States Patent [19]

Gates

[11] Patent Number: 4,974,700

[45] Date of Patent: Dec. 4, 1990

[54] MOVABLE SUPPORT MECHANISM FOR CONSTRUCTION OF ELEVATOR SHAFTS AND THE LIKE

[75] Inventor: H. Gordon Gates, Lakewood, Colo.

[73] Assignee: Gates & Sons, Inc., Denver, Colo.

[21] Appl. No.: 364,229

[22] Filed: Jun. 12, 1989

[51] Int. Cl.[5] ..... E04G 3/00

[52] U.S. Cl. ..... 182/128; 249/20; 425/65; 182/146

[58] Field of Search ..... 182/128, 146; 249/20; 425/65; 248/544, 675, 672, 201, 221.4, 222.1, 231.9, 200.1

[56] References Cited

U.S. PATENT DOCUMENTS

| | | | |
|---|---|---|---|
| 1,591,907 | 7/1926 | Yager | 249/20 X |
| 1,685,012 | 9/1928 | Yager | 249/20 X |
| 3,574,905 | 4/1971 | Jing-Hong | 249/20 X |
| 3,841,596 | 10/1974 | Cull | 425/65 X |
| 3,973,885 | 8/1976 | Schmidt | 425/65 |

FOREIGN PATENT DOCUMENTS

| | | | |
|---|---|---|---|
| 391248 | 9/1971 | U.S.S.R. | 182/128 |

*Primary Examiner*—Karen J. Chotkowski

*Attorney, Agent, or Firm*—Fields, Lewis, Pittenger & Rost

[57] ABSTRACT

An apparatus has been provided for vertically lifting or lowering a workman and/or materials at a construction site. This includes a rectangular platform having four corners for supporting the workman and/or material so that they can be vertically moved within an elevator shaft or the like. The platform has side edges positioned adjacent the side walls of the shaft. The platform can be raised or lowered by a crane. Recesses are provided in opposite side walls for receiving latches attached to the corners of the platform. The latches are locked in place when they are positioned within the recesses and can be retracted when the platform is to be raised and lowered. Also, leveling devices are provided at the corners of the platform for leveling the panels and devices are also provided for holding the panels in proper location prior to pouring the concrete.

6 Claims, 5 Drawing Sheets

MOVABLE SUPPORT MECHANISM FOR CONSTRUCTION OF ELEVATOR SHAFTS AND THE LIKE

TECHNICAL FIELD

This invention relates to a movable support mechanism and more particular to such a mechanism which can support the interior forms for pouring concrete wall sections in an elevator shaft or the like and which can easily be moved upwardly as each section is poured and cured.

BACKGROUND ART

Before the present invention, the erection of forms in the interior of an elevator shaft, stairway shaft and the like was cumbersome and time consuming. One way to position the forms was to erect a semipermanent super structure under the forms at each floor level until the walls for that level were formed and then build additional super structure on top of the original super structure to get up to the next floor and so on. An alternative method was to erect the forms on a vertically movable platform which could be raised by a suitable hoist. However, it was difficult to properly anchor this platform which was suspended by a cable or chain and to properly level and immobilize the interior forms during the concrete pouring operation. In order to do the job properly, many man hours were required and even then sometimes the results were less than totally satisfactory.

DISCLOSURE OF THE INVENTION

In accordance with this invention, a platform for supporting workman and/or materials is vertically movable within a previously formed shaft for an elevator or the like. The platform has means for raising and lowering it within the shaft. There are pocket means provided in each of the side walls and latch means in each of the edges of the platform. Means are also provided for extending the latch means into the pockets for supporting the platform at predetermined locations and for withdrawing the latch means from the pocket means to permit the platform to be raised or lowered within the elevator shaft. The vertically spaced pockets will be provided in each wall section of the elevator shaft as it is formed. Each pocket has a generally horizontal bearing surface extending into the side wall and a sloping upper wall extending from the inner edge of the support surface to the surface of the side wall above the bearing surface so that the pocket has a triangular configuration with the support surface forming the base thereof. The bearing surface includes a bed plate inserted imbedded in the side wall.

The latch includes a horizontal pivot pin mounted at the edge of the platform. The latch member having a generally flat support base is mounted on the pivot pin for pivotal movement between an extended position in which the latch member extends into the pocket with the support base resting on the support surface to hold the platform in a fixed vertical position within the shaft and a retracted position so that the platform can be raised or lowered within the shaft. A removable safety pin is also provided which extends through the platform at a position to prevent movement of the latch member from the extended position to the retracted position. A guide wheel is mounted on the pivot pin to guide the platform along the side walls. The center of gravity of the latch member is located inwardly of the pivot pin when the latch member is retracted so that when the latch member is aligned with the pocket the latch member swings from the retracted position to the extended position in the pocket. The latch member is provided which has a generally flat support base and is mounted on the pivot pin for pivotal movement between an extended position in which the latch member extends into the pocket with the support base resting on the support surface to hold the platform in fixed vertical position within the shaft and retracted position so that the platform can be raised or lowered within the shaft. An adjustable means is provided at each corner of the platform for supporting and leveling the inside form for the elevator shaft. Another adjustable means is provided for holding the forms in place.

The apparatus attached to each corner of the rectangular platform can be in an integral form which includes a horizontal foot for receiving the bottom of a stringer on the platform. A first vertical member extends upwardly from one end of the foot. A second vertical member is parallel and laterally spaced from the first vertical member and has one end attached to and extending upwardly from adjacent the other end of the foot. A top member generally extends parallel to the foot and has one end attached to the upper end of the first vertical member, the upper end of the second vertical member being attached to the top member intermediate the ends. A vertically adjustable support member attached to one end of the top member for supporting and leveling a form and a horizontally adjustable positioning device attached to the top member to hold the form into proper position prior to pouring concrete.

This apparatus can be used in connection with a novel method of constructing a rectangular shaft for elevators, stairways and the like having vertically spaced pockets formed in opposite side walls adjacent the corners thereof. This method comprises erecting wall forms to define the walls of the shaft. Rectangular openings are cut through the forms at the location of the pockets. A pocket is inserted through the openings which include a horizontal wall at the bottom of the pocket to define a horizontal support surface in the finished pocket. A steel bed plate is placed against the lower surface of the horizontal wall. A magnet is placed inside the pocket form so that it rests on the upper surface of the horizontal wall, the magnet being of sufficient strength to hold a bed plate in fixed position against the lower surface of the horizontal wall. The pocket form is attached to the wall form within the opening. Concrete is poured into the wall forms and around the pocket form. The concrete is cured to form a vertical wall section and the pocket form and magnet are removed from the wall form. The method can include the further steps of raising the forms by means of a platform within the shaft which has latches extending into pockets formed in the walls of the shaft, supporting the platform by latches in the pockets, and positioning the forms above the previously poured sections of the shaft for forming a new shaft section above the first shaft section.

Additional advantages of this invention will become apparent from the description which follows, taken in conjunction with the accompanying drawings.

BEST MODE FOR CARRYING OUT THE INVENTION

Figure 1:
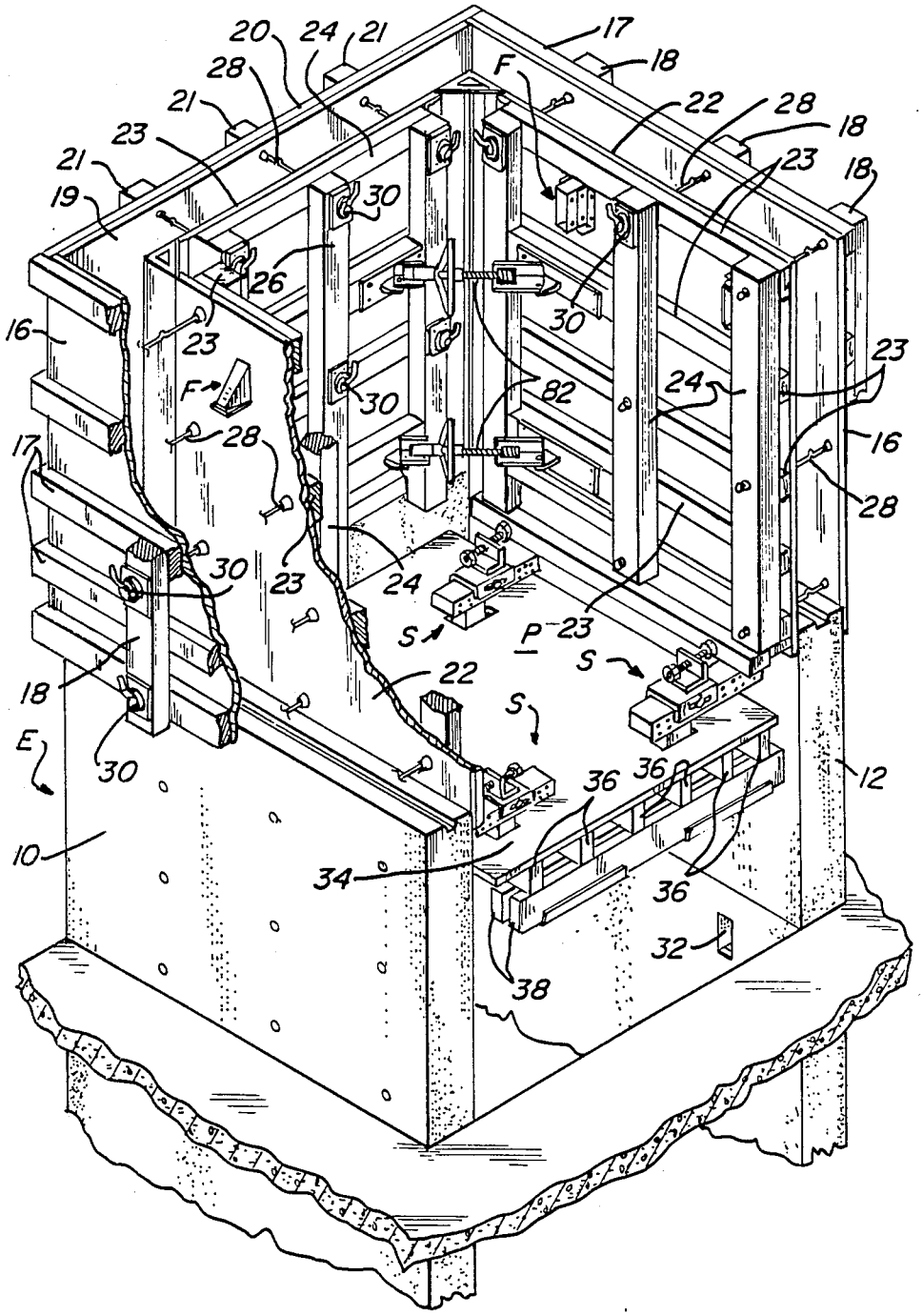
FIG. 1 is a perspective view of an elevator shaft utilizing the movable support mechanism of this invention to support and align interior forms, with parts broken away for clarity of illustration.
Figure 2:
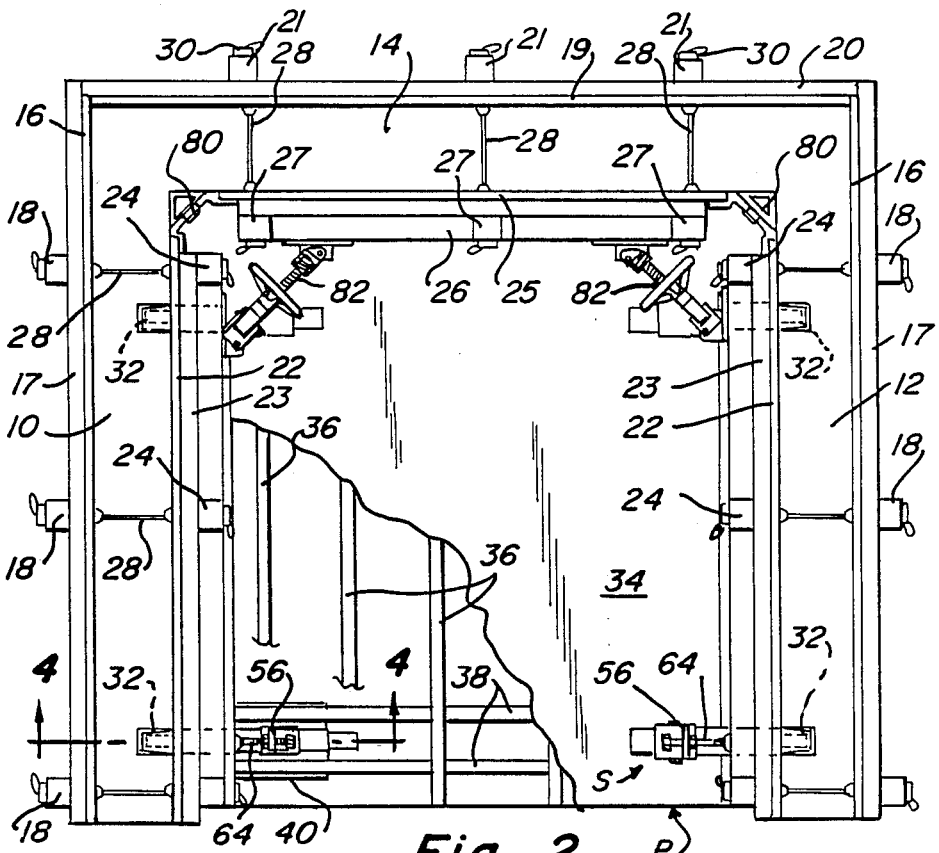
FIG. 2 is a top plan view of the shaft of FIG. 1 prior to positioning of the form ties, with a portion of the platform floor broken away to show further details of the invention.

In accordance with this invention, an elevator shaft E is constructed which includes opposed side wall sections 10 and 12 joined by a back wall section 14. Platform P is movable up the shaft as the wall sections are poured and supports and raises the interior forms. The corresponding exterior forms are supported by other portions of the building structure (not shown). The exterior forms include side form panels 16 reinforced by stringers 18 to which are attached walers 21. These side panels are joined by an outer rear panel 16 having stringers 20 and walers 21. The interior side form panels 22 each have transverse stringers 23 and vertical walers 24. Similarly, a rear inside panel form 25 is provided which extends between side panels 22 and includes transverse stringers 26 and vertical walers 27. Form ties 28 extend between the outer side form panel 16 and the inner side form panels 22 and are held in place by pivotal lock members 30, all as is conventional in the concrete forming art. Similarly, rear outer panel 20 and rear inner panel 25 are interconnected by form ties (not shown) and held in place by lock members 30. Each of side panel forms 22 include a pair of pocket forms F adjacent the upper corners thereof which form laterally spaced pocket means in the form of recesses 32 adjacent the upper corners of each side wall section 10 and 12. These recesses serve as supports for the platform P at each level of construction. This structure will be described more fully below. Platform P includes a floor 34 supported on joists 36 which in turn are supported on transverse stringers 38.

Figure 3:
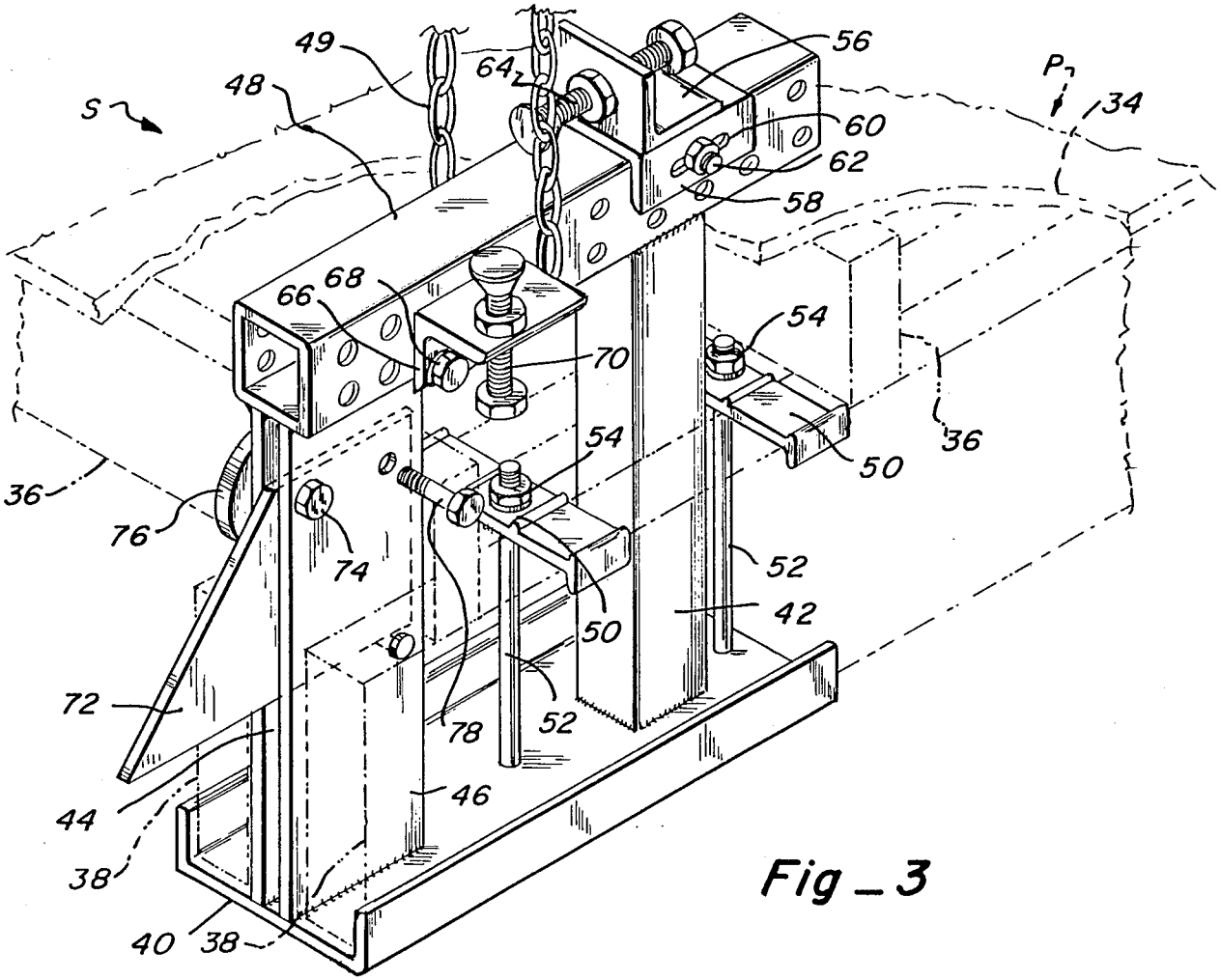
FIG. 3 is a fragmentary enlarged perspective view of one of the corner latch mechanisms of this invention showing its construction.
Figure 6:
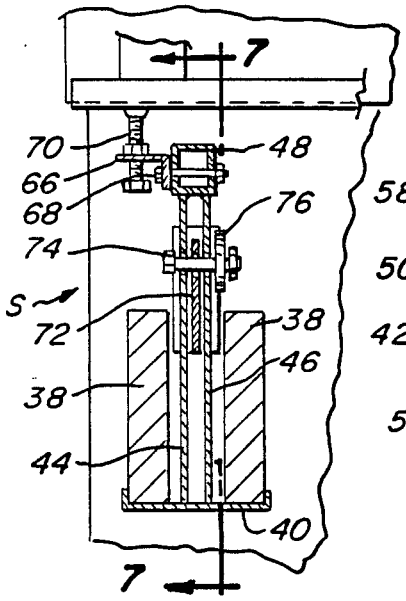
FIG. 6 is an enlarged vertical section, taken along line 6—6 of FIG. 4, showing additional details of the leveling mechanism and the latches for supporting the platform.

A support structure S supports the platform at each corner, as well as leveling, supporting and positioning the inner forms. Support structure S includes a channel shaped foot 40 which supports the outer most pair of stringers 38 at platform P. A first vertical member 42 in the form of a column extends upwardly from the base of channel 40, as best seen in FIG. 3. A second vertical member in the form of spaced plates 44 and 46 extend upwardly from the base of channel 40 at the opposite end thereof. The upper ends of these plates as well as column 42 are interconnected by a transverse tubular top member 48 which can be attached to the plates and the column, as by welding. Means for lifting platform P, such as chain 49 can extend around tube 48, as shown and be connected to a suitable hoist (not shown). The pair of stringers 38 are supported by the base of channel 40 on opposite sides of plates 44 and 46 and opposite sides of column 42, as shown. A pair of clamps 50 engage the tops of the stringers and are secured thereto, as by bolts 52 which extend upwardly through the base of the channel and through the center of the clamps. These bolts receive a nut 54 on the upper threaded ends thereof.

Mounted on top of tube 48 is a slidable bracket 56 which is attached, as by welding, to a U-shaped member 58 having a longitudinal slot 60 in the flanges thereof through which locking bolt 62 passes so that the bracket 56 can be positioned longitudinally along tube 48. A threaded stud 64 extends through an upturned flange of bracket 56 and is adjustable to hold the form in place, as best shown in FIG. 4.

Figure 4:
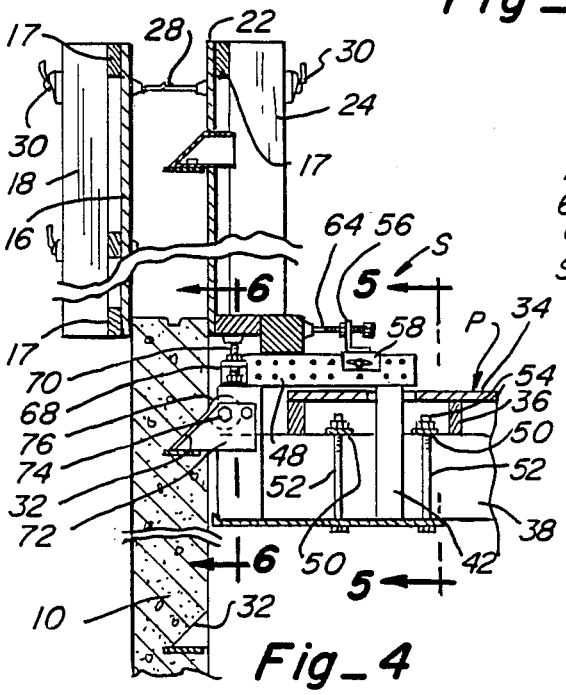
FIG. 4 is an enlarged vertical section, taken along line 4—4 of FIG. 2, showing the platform locking mechanism and the structure for holding the forms.
Figure 5:
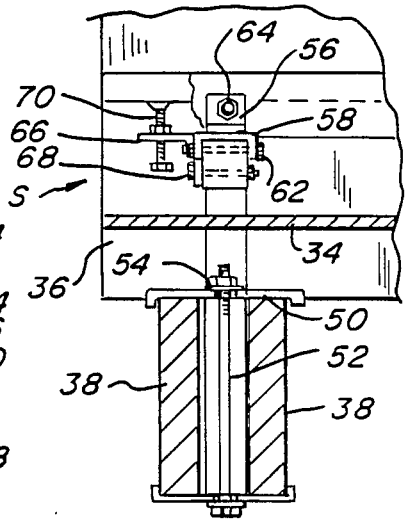
FIG. 5 is an enlarged vertical section, taken along line 5—5 of FIG. 4, showing further details of the mechanism for supporting and leveling the forms.

A second bracket 66 is attached by means of a bolt 68 to the side of tube 48 and has a vertical stud 70 which extends through the horizontal flange of the bracket for leveling the form panel, as best seen in FIGS. 4 and 5.

Figure 7:
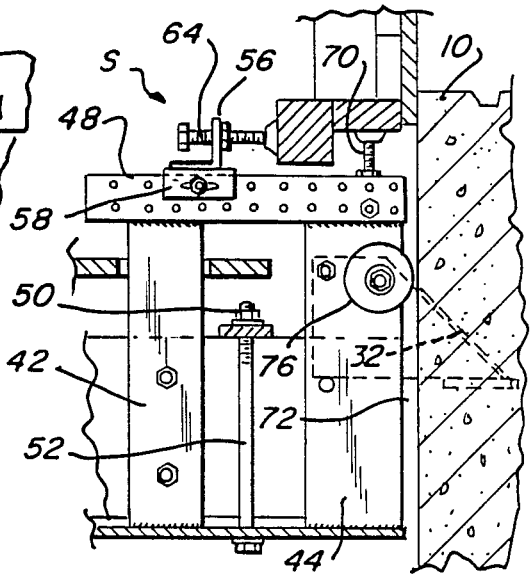
FIG. 7 is a vertical section, taken along line 7—7 of FIG. 6, showing additional details of the leveling mechanism and the latch mechanism.
Figure 8:
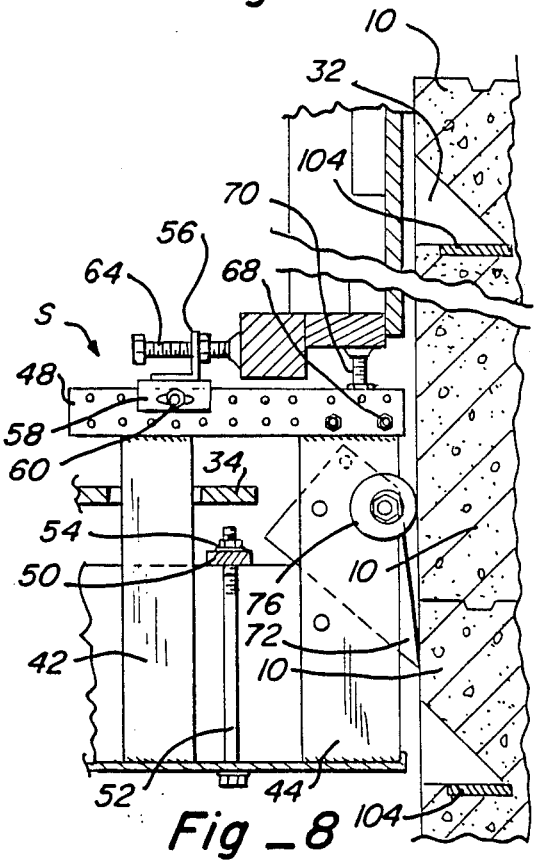
FIG. 8 is a fragmentary vertical section, similar to FIG. 7, but showing the platform being raised from one level to the next.

Conveniently, a latch plate 72 is mounted for pivotal movement between vertical plates 44 and 46 for pivotal movement about pin shaft 74. It can be seen that the center of gravity of latch plate 72 is inward of pivot pin shaft 74, it will tend to swing outwardly into an extended locking position under the influence of gravity. Conveniently, guide wheel 76 is also mounted on pin shaft 74 but outwardly of plate 44. When the latch plate is in the extended position, shown in FIG. 3, a safety bolt 78 can be inserted through apertures in the latch plate and vertical plates 44 and 46 to maintain the latch plate in extended locking position when it is inserted in a pocket 32 of a previously poured concrete wall section 10. When it is desired to move the platform from one level up to the next, i.e., from the position shown in FIG. 7, up through the position shown in FIG. 8, the safety bolt 78 will be removed and the latch plate will be pivoted inwardly by the newly poured concrete wall as the platform is lifted, as by a crane (not shown).

It will be understood that the support structure S just described will be provided at each corner of platform P and provides a means for locking the platform in recess 32 at one level while forms are positioned above the platform for pouring the next portion of the elevator shaft. After that portion has been poured and has cured sufficiently, safety bolts 78 are withdrawn and the platform is raised to the next level where the latches will be engaged with the next set of recesses 32. Conveniently, rear panel 25 and side panels 22 are interconnected at their corners by corner forms 80, the forms being held in place by a retractable corner mechanism 82 which is manufactured by Gates & Sons, Inc. of Denver, Colorado. Thus, after a section has been poured and cured, the inner forms can be withdrawn inwardly and raised with the platform and the outer forms can be removed in a conventional fashion and reconstructed at the next higher level.

Figure 9:
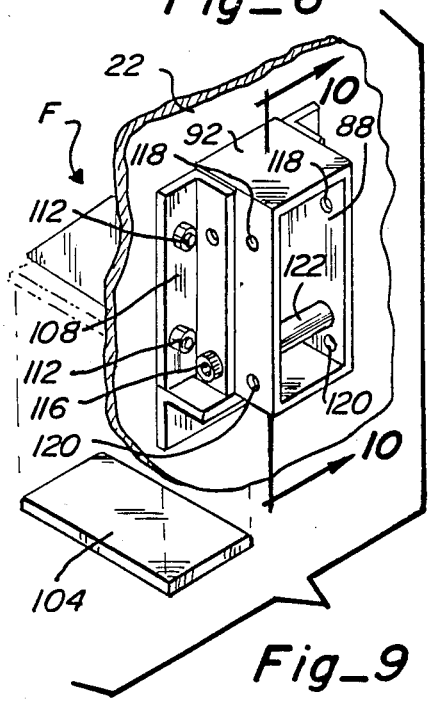
FIG. 9 is a fragmentary, exploded, perspective view showing the pocket construction in the form.
Figure 10:
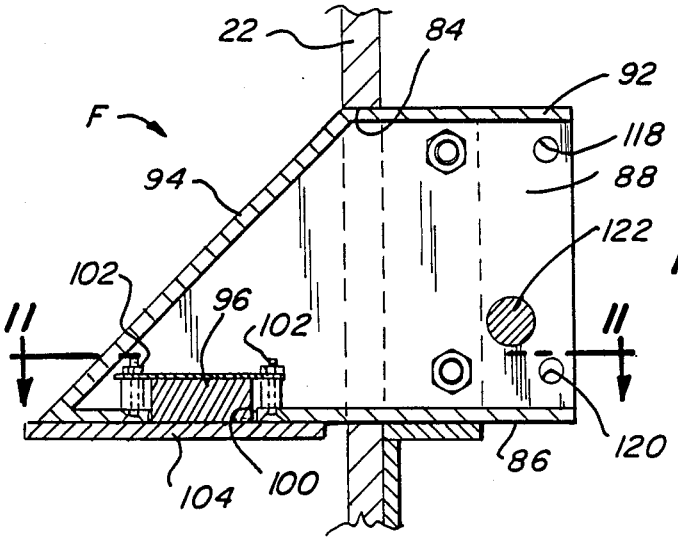
FIG. 10 is an enlarged vertical section, taken along line 10—10 of FIG. 9, showing further details of the pocket construction.
Figure 11:
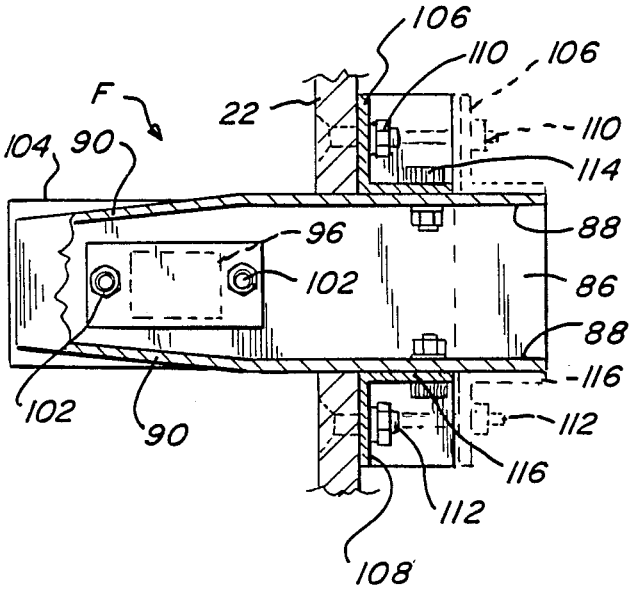
FIG. 11 is a horizontal section, taken along line 11—11 of FIG. 10, showing still additional details of the pocket construction.

As previously mentioned, each interior side form panel 22 includes two pocket forms F adjacent the upper corners thereof. These pocket forms are best seen in FIGS. 9–11. Each pocket extends through an opening 84 in panel 22 with a portion of the pocket form F extending outwardly of panel 22 and a portion thereof extending inwardly. The pocket form F is made of metal and includes a base plate 86 which extends through and rests on the lower portion of opening 84. Base 86 is formed integrally with vertical side walls 88 which have inwardly tapered portions 90 outwardly of panel 22. The pocket form F is completed by a top wall 92 and a downwardly sloping forward wall 94. The tapering of the outwardly extending portion of pocket form F facilitates removal of the form after the concrete is poured and cured.

A permanent magnet 96 extends through an opening 100 in base plate 86 and is mounted flush with the bottom of the base plate by means of mounting screws 102. An anchor plate 104 is held against base plate 86 by magnet 96 during pouring of the concrete. After the concrete is poured and cured, inner panels 22 are moved inwardly away from the adjacent side wall sections, the plate 104, which is now imbedded in the concrete at each recess 32, will remain in place. Since the magnet slides longitudinally along the face of plate 104 as pocket form F is withdrawn from recess 32 it will not offer substantial resistance to separation of the inner panels from the newly poured concrete wall. These anchor plates provide substantial support for latch plates 72 when the platform is moved up to the next level. If panel 22 is made of metal, the pocket form will be attached thereto by a pair of angles 106 and 108 which are attached to panel 22, as by bolts 110 and 112, respectfully, as shown in solid lines in FIG. 11. The flanges are connected to the side walls 88 of pocket form F by means of bolts 118 and 120, respectfully extending through a first pair of openings in the side walls. A second pair of openings 118 and 120 are provided and can be used for bolts 114 and 116 when a wooden panel 22 is used that has reinforcing timbers behind the opening making the total thickness of the form greater. In this situation, angles 106 and 108 are in the dotted line position shown in FIG. 11.

A rod 122 extends transversely between side walls 88 and is welded thereto. This rod can be engaged by the end of a crowbar to help dislodge the pocket forms F from the recesses 32 after the concrete has cured.

From the foregoing, the advantages of this invention are readily apparent. A movable platform has been provided which includes releasable latch devices that can be locked into recesses in previously poured portions of an elevator shaft or stairway shaft and support the inner form panels while additional upper sections are poured. These form panels include pocket forms which create the recesses in the next poured wall section which will be used by the platform when it is raised to the next level. The latch mechanism for supporting the platform can be securely locked in place when it is being used but the latches are made so that they can swing inwardly when the safety pins are withdrawn. Conveniently, the latches are constructed and mounted so that their center of gravity is off center from the pivot point causing them to swing into open position. Guide rollers are also provided which allow the platform to be raised without scratching or marring the newly poured concrete after the form panels are removed and during raising of the platform to the next level.

It will be understood that although an elevator shaft has been shown for use with a single elevator that the shaft could be much wider to accommodate a plurality of elevators. Also, the construction could be used in connection with a stairway wherein a panel would be put on the fourth open side to form a closed rectangular shaft. In this case, doorways could be formed into the panels, as required at each floor level.

I claim:

1. Apparatus for vertically lifting or lowering a workman and/or materials at a construction site, said apparatus comprising:

an elevator or stairway shaft having opposed side walls and corners;

a rectangular platform, having four corners, for supporting workmen and/or materials vertically movable within said shaft, said platform having side edges adjacent said side walls of said shaft;

means for raising or lowering said platform within said shaft;

pocket means in said side walls;

latch means in said side edges;

means for extending said latch means into said pockets for supporting said platform at a predetermined location and for withdrawing said latch means from said pocket means to permit said platform to be raised or lowered within said elevator shaft;

a vertically adjustable means at each corner of said platform for supporting and raising or lowering each corner to level a form for forming a portion of the shaft above said platform; and a horizontally adjustable pushing device at each corner of said platform to push the forms in place.

2. Apparatus for attachment adjacent each corner of a rectangular platform used in construction of a shaft having side walls with vertically spaced pockets which have support surfaces, for elevators, stairways and the like, said apparatus comprising:

a generally horizontal foot, having first and second ends, for receiving the bottom of a stringer on the platform;

a first vertical member having one end attached to and extending upwardly from one end of said foot;

a second vertical member, parallel to and laterally spaced from said first vertical member, having one end attached to and extending upwardly from adjacent the other end of said foot;

a top member generally parallel to said foot and having one end attached to the upper end of said first vertical member, the upper end of said second vertical member being attached to said top member intermediate the ends thereof; and a latch member having a generally flat support base, said latch member being mounted on a longitudinal pivot pin for pivotal movement between an extended position in which said latch member is extendable into the pocket sos that said support base can rest on the support surface to hold said platform in a fixed vertical position within said shaft and a retracted position so that said platform can be raised or lowered within the shaft.

3. Apparatus, as claimed in claim 2, further including:

a removable safety pin extendable through said platform at a position to prevent movement of said latch member from said extended position to said retracted position.

4. Apparatus, as claimed in claim 2, wherein:

each said latch member has a center of gravity located inwardly of said pivot pin when said latch member is retracted so that when said latch member is aligned with the pocket said latch member swings from retracted position to extended position in the pocket.

5. Apparatus, as claimed in claim 2, further including:

a vertically adjustable support member attached to said one end of said top member for supporting and leveling a form for forming the shaft above the platform; and a horizontally adjustable pushing device attached to said top member to push the form into proper position prior to pouring concrete.

6. Apparatus, as claimed in claim 2, further including:

a roller mounted for rotation on to a horizontal pivot pin attached said first vertical member and having a peripheral edge extending beyond said first vertical member for engagement with the wall of said shaft to guide the platform during vertical movement thereof within the shaft.

* * * * *